US010159385B2

(12) United States Patent
Beckerman et al.

(10) Patent No.: US 10,159,385 B2
(45) Date of Patent: Dec. 25, 2018

(54) DISPENSER

(71) Applicant: COLGATE-PALMOLIVE COMPANY, New York, NY (US)

(72) Inventors: Scott Beckerman, South Orange, NJ (US); Andrew Lanza, West New York, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/351,820

(22) Filed: Nov. 15, 2016

(65) Prior Publication Data

US 2018/0132670 A1 May 17, 2018

(51) Int. Cl.

| | |
|---|---|
| ***A47K 5/18*** | (2006.01) |
| ***A47K 5/122*** | (2006.01) |
| ***B65D 1/32*** | (2006.01) |
| ***B65D 35/08*** | (2006.01) |
| ***B65D 47/08*** | (2006.01) |
| ***B65D 25/14*** | (2006.01) |
| ***B65D 1/14*** | (2006.01) |
| ***B65D 1/40*** | (2006.01) |

(52) U.S. Cl.

CPC ..... *A47K 5/122* (2013.01); *A47K 5/18* (2013.01); *B65D 1/14* (2013.01); *B65D 1/32* (2013.01); *B65D 1/40* (2013.01); *B65D 25/14* (2013.01); *B65D 35/08* (2013.01); *B65D 47/08* (2013.01); *B65D 2231/005* (2013.01)

(58) Field of Classification Search

CPC ..... A47K 5/122
USPC ..... 222/213
See application file for complete search history.

(56) References Cited

U.S. PATENT DOCUMENTS

| | | | | |
|---|---|---|---|---|
| 3,645,423 | A * | 2/1972 | DeGraw | B65D 83/06 222/207 |
| 5,373,967 | A | 12/1994 | Grooms et al. | |
| 6,402,019 | B1 * | 6/2002 | Casale | B65B 61/186 220/258.1 |
| 7,178,687 | B1 | 2/2007 | Manderfield, Jr. et al. | |
| 7,228,981 | B2 | 6/2007 | Chisholm | |
| 8,490,819 | B2 * | 7/2013 | Vanblaere | B65D 83/425 220/500 |
| 8,940,361 | B2 | 1/2015 | Smith et al. | |
| 2006/0230944 | A1 * | 10/2006 | Neace, Jr. | A47J 31/16 99/279 |
| 2009/0185454 | A1 * | 7/2009 | Allen | G04F 1/06 368/93 |

(Continued)

FOREIGN PATENT DOCUMENTS

| | | | |
|---|---|---|---|
| CN | 2540372 | Y | 3/2003 |
| CN | 201012815 | Y | 1/2008 |
| CN | 201587565 | U | 9/2010 |

(Continued)

OTHER PUBLICATIONS

International Search Report and Written Opinion of the International Searching Authority in International Application No. PCT/US2017/061563, dated Jan. 16, 2018.

*Primary Examiner* — Jeremy Carroll

(57) ABSTRACT

A dispenser includes a spiral-shaped body having a first end and a second end. The body defines an internal volume and an opening that provides a path of fluid communication between the internal volume and an exterior of the body. A composition is in the internal volume.

7 Claims, 8 Drawing Sheets

(56) References Cited

U.S. PATENT DOCUMENTS

| | | | | |
|---|---|---|---|---|
| 2009/0324521 | A1 | 12/2009 | Cetti et al. | |
| 2014/0209640 | A1* | 7/2014 | Levenstein ..... | B65D 83/384<br>222/325 |

FOREIGN PATENT DOCUMENTS

| | | | |
|---|---|---|---|
| JP | 2015-074502 | A | 4/2015 |
| WO | 2007/050330 | | 5/2007 |

* cited by examiner

DISPENSER

BACKGROUND

Compositions are typically stored in a dispenser. For example, toothpaste may be stored in a tube that is squeezed to eject the toothpaste therefrom. In another example, a shampoo may be stored in a bottle, and the shampoo may be poured out of the bottle. The composition may have a tendency to separate into portions of higher and lower densities in conventional dispensers. In addition, conventional dispensers do not appeal to children, and thus, provide no incentive for the children to use the composition. What is needed is an improved dispenser.

BRIEF SUMMARY

A dispenser includes a spiral-shaped body having a first end and a second end. The body defines an internal volume and an opening that provides a path of fluid communication between the internal volume and an exterior of the body. A composition is in the internal volume.

In another embodiment, the dispenser includes a body having a first portion, a second portion, and a neck portion. The first portion defines a first internal volume, and the second portion defines a second internal volume. The neck portion is positioned between the first and second portions and provides a path of fluid communication between the first and second internal volumes. A minimum cross-sectional width of the neck portion is less than about 20% of a maximum cross-sectional width of the first portion, the second portion, or both. A composition is in the first internal volume, the second internal volume, or both.

A method for dispensing a composition from a dispenser is also disclosed. The method includes rotating a spiral-shaped body about a longitudinal axis. The body includes a curved central axis that extends from a first end to a second end, and the longitudinal axis is perpendicular to a plane that includes the central axis. A lid that is coupled to the body is opened to allow the composition to flow out of the body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
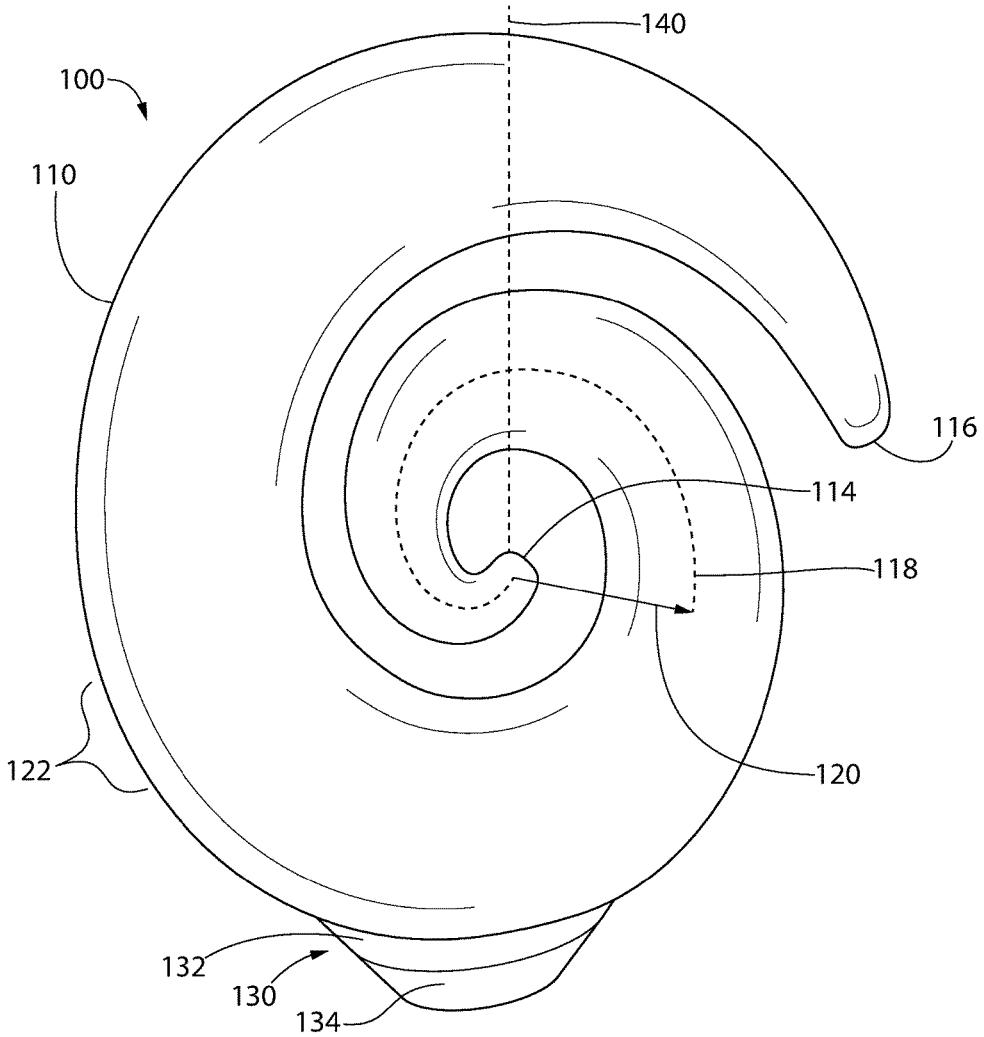
FIG. 1 depicts a perspective view of a spiral-shaped dispenser in an upright position, according to an embodiment.
Figure 2:
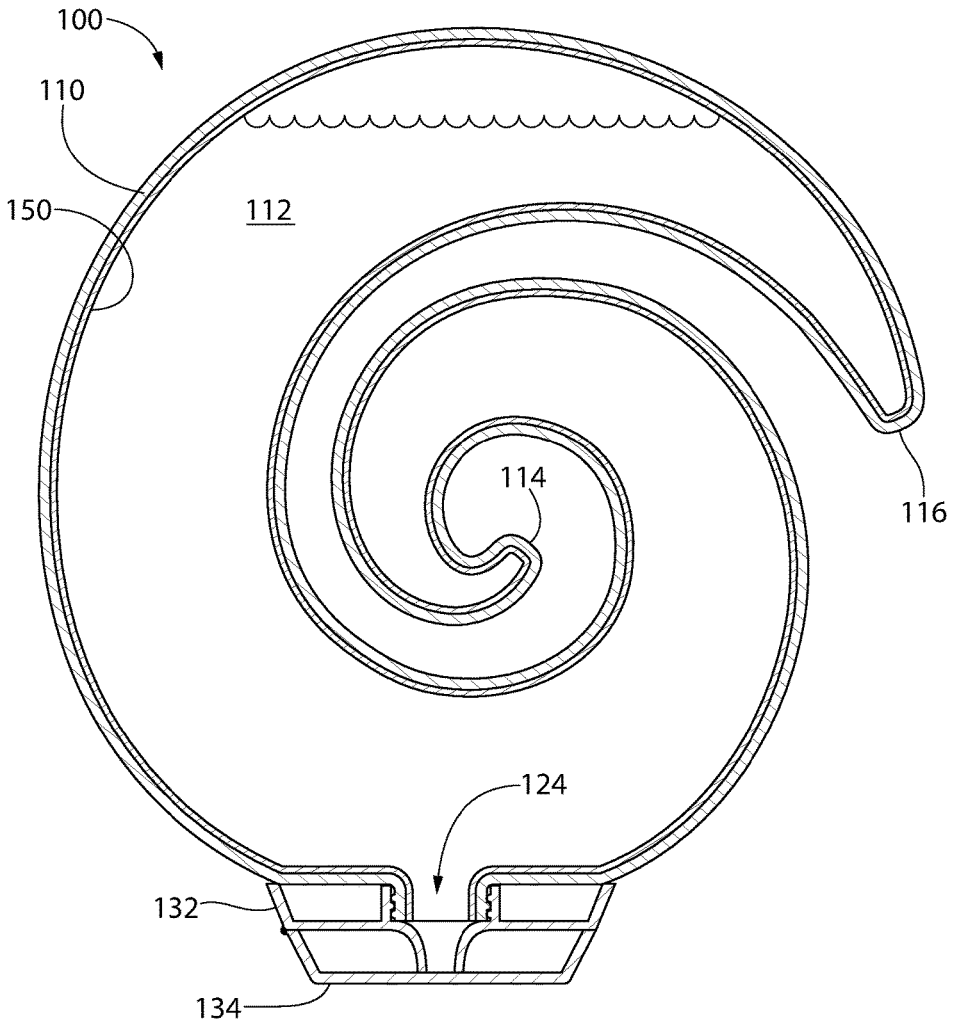
FIG. 2 depicts a cross-sectional side view of the spiral-shaped dispenser in an upright position, according to an embodiment.

FIGS. 1 and 2 depict a perspective view and a cross-sectional side view, respectively, of a spiral-shaped dispenser 100, according to an embodiment. The dispenser 100 may include a body 110. The body 110 may be made of a polymer or elastomer. For example, the body 110 may be made of a blow-molded polyethylene terephthalate ("PET"). The body 110 may define an internal volume. A composition 112 may be stored in the internal volume. The composition 112 may be or include a dentifrice composition (e.g., toothpaste, tooth powder, tooth soap, mouthwash). In other embodiments, the composition 112 may be or include personal care or home care compositions such as lotions, soap, shampoo, conditioner, dish detergent, laundry detergent, fabric softener, surface cleaners, etc. In at least one embodiment, the body 110 may be at least partially transparent or translucent so that the user may see the composition 112 in the internal volume.

The body 110 may be substantially spiral-shaped. As shown, the body 110 may include a first (e.g., "inner") end 114 and a second (e.g., "outer") end 116. The body 110 may include a curved, spiral central axis 118 that extends from the first end 114 to the second end 116. The central axis 118 may extend around the first end 114 from about 180° to about 270°, about 270° to about 360°, about 360° to about 450°, about 450° to about 540°, about 540° to about 630°, about 630° to about 720°, or more. In the embodiment shown, the central axis 118 extends through about 630°. As shown, the body 110 may be in the shape of a two-dimensional spiral, where the central axis 118 is in a plane. In another embodiment, the body 110 may be in the shape of a three-dimensional spiral, where the central axis 118 is in the shape of a helix.

A radial distance 120 between the first end 114 and the central axis 118 may increase proceeding along the central axis 118 away from the first end 114. A cross-sectional shape of the body 110, in a plane perpendicular to the central axis 118 may be substantially circular, ovular, rectangular, or the like. A cross-sectional area through the body 110, in the plane perpendicular to the central axis 118, may increase proceeding away from the first end 114 to a portion of maximum cross-sectional area 122. The cross-sectional area through the body 110 may then decrease proceeding away from the portion of maximum cross-sectional area 122 toward the second end 116. Although not shown in the Figures, in another embodiment, the cross-sectional area may remain substantially constant proceeding from the first end 114 to the second end 116. Although not shown, in another embodiment, the cross-sectional area may increase (with no decrease) proceeding from the first end 114 to the second end 116. Although not shown, in another embodiment, the cross-sectional area may decrease (with no increase) proceeding from the first end 114 to the second end 116.

The body 110 may define an opening 124 (see FIG. 2) that provides a path of fluid communication between the internal volume and an exterior of the body 110. The opening 124 may be positioned between the first and second ends 114 of the body 116. As shown, the opening 124 may be positioned on an outer radial surface of the body 110. In another embodiment, the opening 124 may be positioned on a side surface of the body 110 (e.g., rotated 90° from the outer radial surface with respect to the central axis 118). In yet another embodiment, the opening 124 may be positioned proximate to (e.g., through) the second end 116 of the body 110.

A lid 130 may be coupled to the body 110. The lid 130 may be aligned with and/or covering the opening 124. The lid 130 may be coupled to the body 110 using a threaded engagement, a snap-fit engagement, adhesive, or the like.

Figure 3:
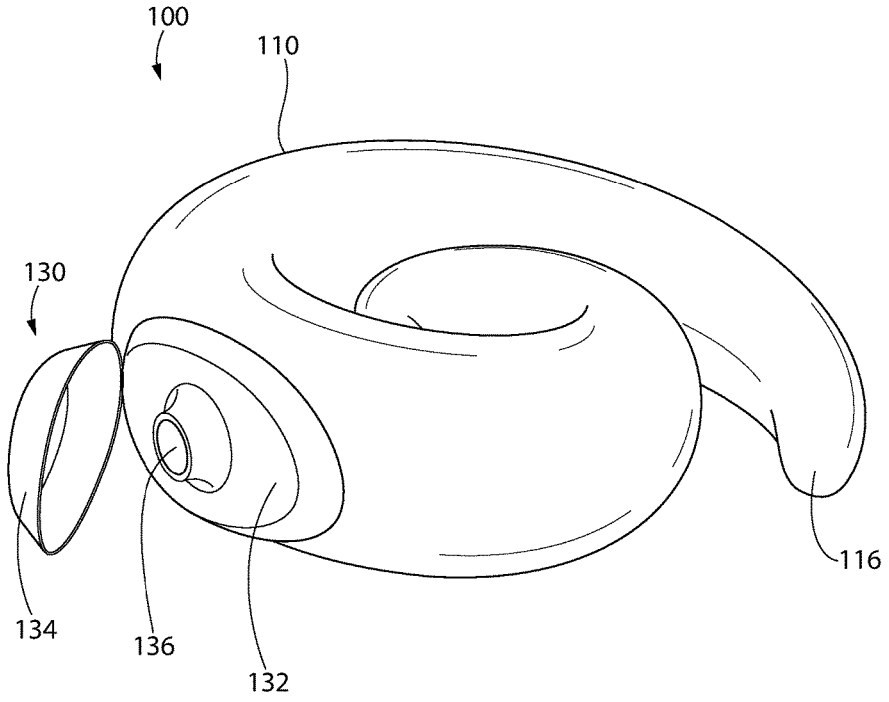
FIG. 3 depicts a perspective view of the spiral-shaped dispenser on its side showing a lid in an open position, according to an embodiment.

FIG. 3 depicts a perspective view of the dispenser 100 on its side showing the lid 130 in an open position, according to an embodiment. The lid 130 may include a base 132 and a cap 134. The base 132 may be coupled to the body 110 of the dispenser 100. The base 132 may have an opening (e.g., a nozzle) 136 formed therethrough.

The cap 134 may be coupled to the base 132 by one or more hinges. In another embodiment, the cap 134 may screw or snap onto the base 132. The cap 134 is shown in a closed position in FIGS. 1 and 2. The cap 134 may prevent the composition 112 from flowing through the openings 124, 136 when the cap 134 is in the closed position. The cap 134 may pivot or rotate about the hinge(s) into an open position, as shown in FIG. 3. The composition 112 may flow through the openings 124, 136 and, for example, into a user's mouth or onto a user's toothbrush when the cap 134 is in the open position.

Referring again to FIGS. 1 and 2, the outer surface of the cap 134 may be substantially flat. As a result, when the lid 130 is in the closed position, the outer surface of the cap 134 may rest upon a horizontal external surface (e.g., of a table or a counter top), and the lid 130 may be positioned between the body 110 and the external surface to hold the dispenser in an "upright" position as shown in FIG. 2. A plane through the central axis 118 may be substantially perpendicular to the external surface. When the dispenser 100 is in this position (i.e., the "upright" position), the opening 124 in the body 110 may be the lowest (or close to the lowest) point on the body 110, such that gravity may cause the composition 112 to aggregate near the opening 124. This may allow a user to quickly dispense the composition 112 from the dispenser 100.

Due to the curvature of the body 110, at least a portion of the composition 112 in the internal volume may not be able to flow to the opening 124 in the body 110 when the body 110 is in the upright position because the path to the opening 124 may be at least partially upward. For example, the portion of the composition 112 between the first end 114 and the dashed line 140 may not be able to flow to the opening 124 in the body 110 when the body 110 is in the upright position. Similarly, the portion of the composition 112 between the dashed line 140 and the second end 116 may not be able to flow to the opening 124 in the body 110 when the body 110 is in the upright position. As a result, to cause these portions of the composition 112 to flow to the opening 124, the user must rotate the body 110 clockwise or counter-clockwise about an axis through the first end 114 that is perpendicular to a plane containing the central axis 118.

An inner surface of the body 110 that defines the internal volume may include a coating 150 disposed thereon (see FIG. 2). A coefficient of friction between the composition 112 and the coating 150 may be less than a coefficient of friction between the composition 112 and an inner surface of the body 110. The coating 150 may prevent the composition 112 from sticking to the inner surface of the body 110, thereby allowing the composition 112 to slide or slosh or otherwise move around within the internal volume of the body 110 when the user rotates the dispenser 100. In at least one embodiment, the coating 150 may be or include a liquid-impregnated surface, as described in U.S. Pat. No. 8,940,361. For example, the coating 150 may include a matrix of solid features spaced sufficiently close to stably contain a liquid therebetween or therewithin. In at least one embodiment, the coating 150 may be or include LiquiGlide® manufactured by LiquiGlide Inc. of Cambridge, Mass.

Rotating the dispenser 100 may serve to mix the composition 112 within the internal volume of the body 110 to help the composition remain substantially uniform over time, rather than potentially separating into a higher density portion and a lower density portion. Furthermore, the shape of the dispenser 100 may amuse, entertain, or appeal to young children, which may encourage them to use the composition 112 (e.g., to brush their teeth).

In operation, a user may grasp the dispenser 110 and open the lid 130. The composition 112 may flow out through the opening 124 in the body 110 and the opening 136 in the lid 130 due to gravity. The user may also squeeze the body 110 to cause the composition 112 to flow out through the opening 124 in the body 110 and the opening 136 in the lid 130. When the level of composition 112 in the internal volume is low, the user may have to rotate the body 110 to cause some of the composition 112 to flow toward the openings 124, 136. After the composition 112 has flowed out of the body 110, the user may close the lid 130, and place the dispenser 100 on a substantially horizontal surface in its upright position.

Figure 4:
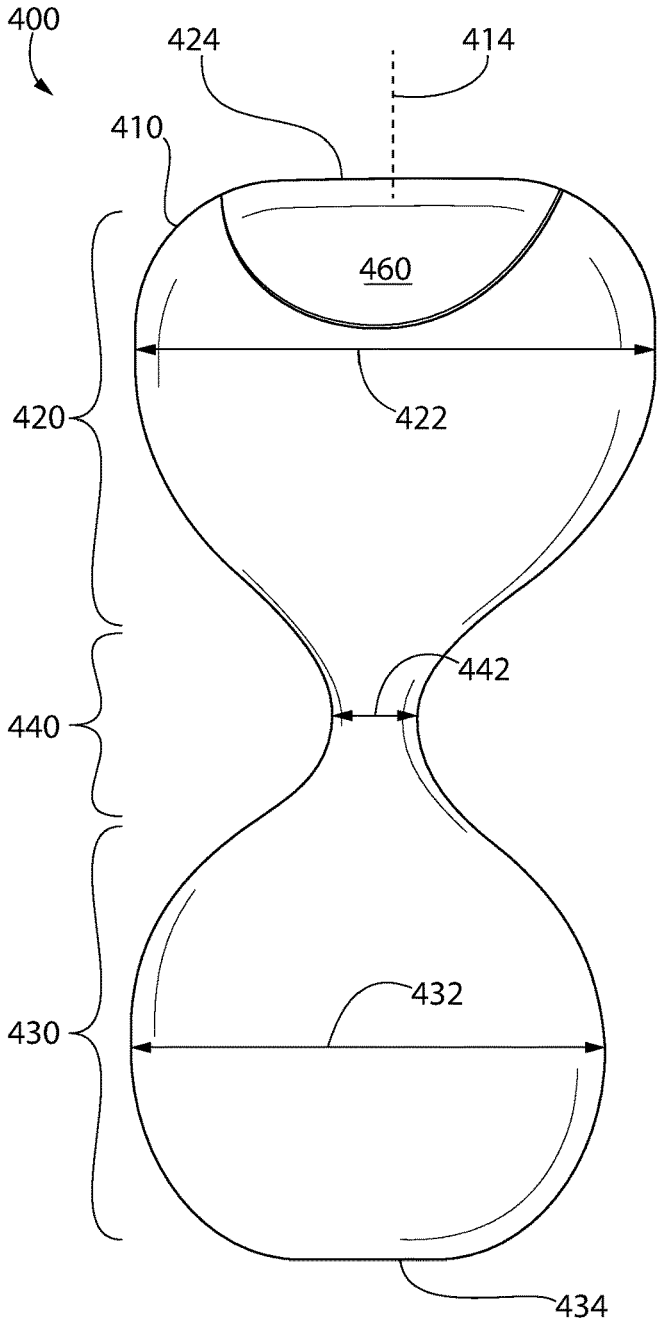
FIG. 4 depicts a perspective view of an hourglass-shaped dispenser, according to an embodiment.
Figure 5:
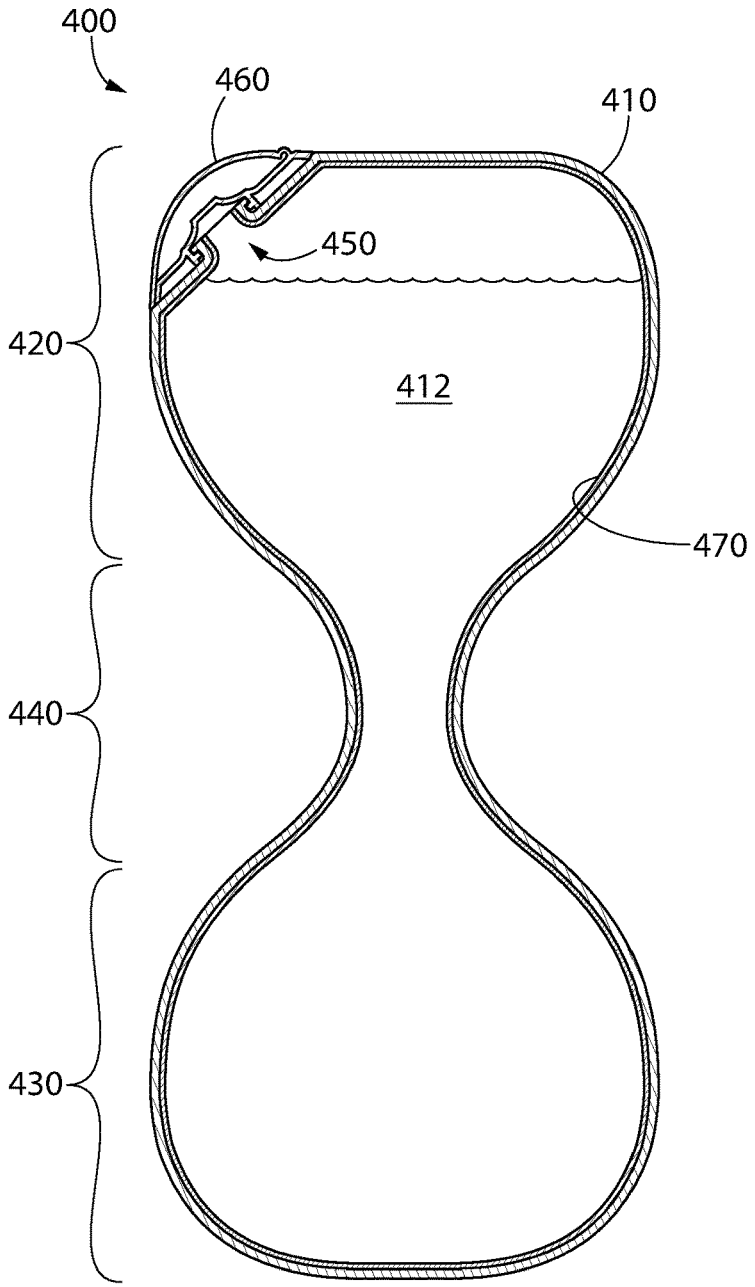
FIG. 5 depicts a cross-sectional side view of the hourglass-shaped dispenser of FIG. 4, according to an embodiment.

FIGS. 4 and 5 depict a perspective view and a cross-sectional side view, respectively, of an hourglass-shaped dispenser 400, according to an embodiment. The dispenser 400 may include a body 410. The body 410 may be made of a polymer or elastomer. For example, the body 410 may be made of a blow-molded polyethylene terephthalate ("PET"). The body 410 may define an internal volume. A composition 412 may be stored in the internal volume. The composition 412 may be or include a dentifrice composition (e.g., toothpaste, tooth powder, tooth soap, mouthwash). In other embodiments, the composition 412 may be or include personal care or home care compositions such as lotions, soap, shampoo, conditioner, dish detergent, laundry detergent, fabric softener, surface cleaners, etc. In at least one embodiment, the body 410 may be at least partially transparent or translucent so that the user may see the composition 412 in the internal volume.

The body 410 may be substantially hourglass-shaped with a central longitudinal axis 414 extending therethrough. As shown, the body 410 may include a first (e.g., "upper") portion 420 and a second (e.g., "lower") portion 430, although the terms "upper" and "lower" are relative because the body 410 may be flipped. The first portion 420 of the body 410 may include a first portion of the internal volume, and the second portion 430 of the body 410 may include a second portion of the internal volume. An axial end of the first portion 420 may include a flat outer surface 424, and an axial end of the second portion 430 may include a flat outer surface 434, such that the body 410 may be in an upright position when resting on either one of the surfaces 424, 434. The body 410 may also include a narrow neck portion 440 positioned between the first and second portions 420, 430. The neck portion 440 may provide a path of fluid communication between the first and second portions of the internal volume.

When a cross-section is taken through the body 410 in a plane that is perpendicular to the central longitudinal axis 414, the cross-sectional shape of the body 410 may be substantially circular at any height along the central longitudinal axis 414. The cross-sectional width of the first portion 420 of the body 410 may decrease proceeding from a maximum cross-sectional width 422 toward the neck portion 440. The cross-sectional width may then increase again proceeding from the neck portion 440 toward a maximum cross-sectional width 432 of the second portion 430 of the body 410. A minimum cross-sectional width 442 of the neck portion 440 may be less than about 50%, less than about 25%, or less than about 10% of the maximum cross-sectional width 422 of the first portion 420, the maximum cross-sectional width 432 of the first portion 430, or both.

The minimum cross-sectional width 442 of the neck portion 440 may be from about 10 mm to about 20 mm or from about 20 mm to about 30 mm. The minimum cross-sectional width 442 may be dependent on the viscosity of the composition 412, the coating 470 (introduced below) on the inner surface of the body 410), or a combination thereof. The cross-sectional width 442 of the neck portion 440 may be less than the cross-sectional widths 422, 432 of the first and second portions 420, 430 to slow down the flow of the composition 412 moving from the first portion 420 to the second portion 430, creating an hourglass-like movement, where the composition 412 pools up and then slowly flows in the second (e.g., lower) portion 430. This provides visual interest and reminds the user to be conscious of the time that the user is brushing or rinsing. The hourglass shape may provide a timing function. More particularly, the user may brush or rinse until all of the composition 412 has flowed from the first (e.g., upper) portion 420 to the second (e.g., lower) portion 430. However, the time may decrease as the amount of composition 412 decreases.

The body 410 may define an opening 450 (shown in FIG. 5, but not shown under the lid 460 in FIG. 4) that provides a path of fluid communication between the internal volume and an exterior of the body 410. The opening 450 may be positioned proximate to an axial end of the first portion 420 of the body 410 or the second portion 430 of the body 410. Although not shown, in another embodiment, the opening 450 may be formed on/through the neck portion 440 of the body 410.

A lid 460 may be coupled to the body 410 and be aligned with and/or cover the opening 450. The lid 460 may be coupled to the body 410 using a threaded engagement, a snap-fit engagement, adhesive, or the like. In at least one embodiment, the lid 460 may be substantially flush with the outer surface of the body 410, as shown in FIG. 4.

The user may flip/rotate the body 180° (e.g., like an hourglass) to cause the composition 412 to flow from one portion of the body 410 (e.g., the first portion 420), through the neck portion 440, and into the other portion of the body 410 (e.g., the second portion 430), and vice versa. Flipping/rotating the body 410 may serve to mix the composition 412 within the internal volume of the body 410 to help the composition 412 remain substantially uniform over time, rather than potentially separating into a higher density portion and a lower density portion. Furthermore, watching the composition 412 flow like sand in an hourglass may amuse, entertain, or appeal to young children, which may encourage them to use the composition 412 (e.g., to brush their teeth).

An inner surface of the body 410 that defines the internal volume may include a coating 470 disposed thereon (see FIG. 5). A coefficient of friction between the composition 412 and the coating 470 may be less than a coefficient of friction between the composition 412 and an inner surface of the body 410. The coating 470 may prevent the composition 412 from sticking to the inner surface of the body 410, thereby allowing the composition 412 to slide or slosh or otherwise move around within the internal volume of the body 410 when the user flips/rotates the dispenser 400. In at least one embodiment, the coating 470 may be or include LiquiGlide®.

In operation, a user may grasp the dispenser 410 and open the lid 460. The user may then flip/rotate the dispenser 410 180° so that the composition 412 may flow out through the opening 450 in the body 410 due to gravity. The user may also squeeze the body 410 to cause the composition 412 to flow out through the opening 450 in the body 410. After the composition 412 has flowed out of the body 410, the user may flip/rotate the dispenser 410 180° again so that the body 410 is upright (e.g., as shown in FIG. 5), and the user may close the lid 460.

Figure 6:
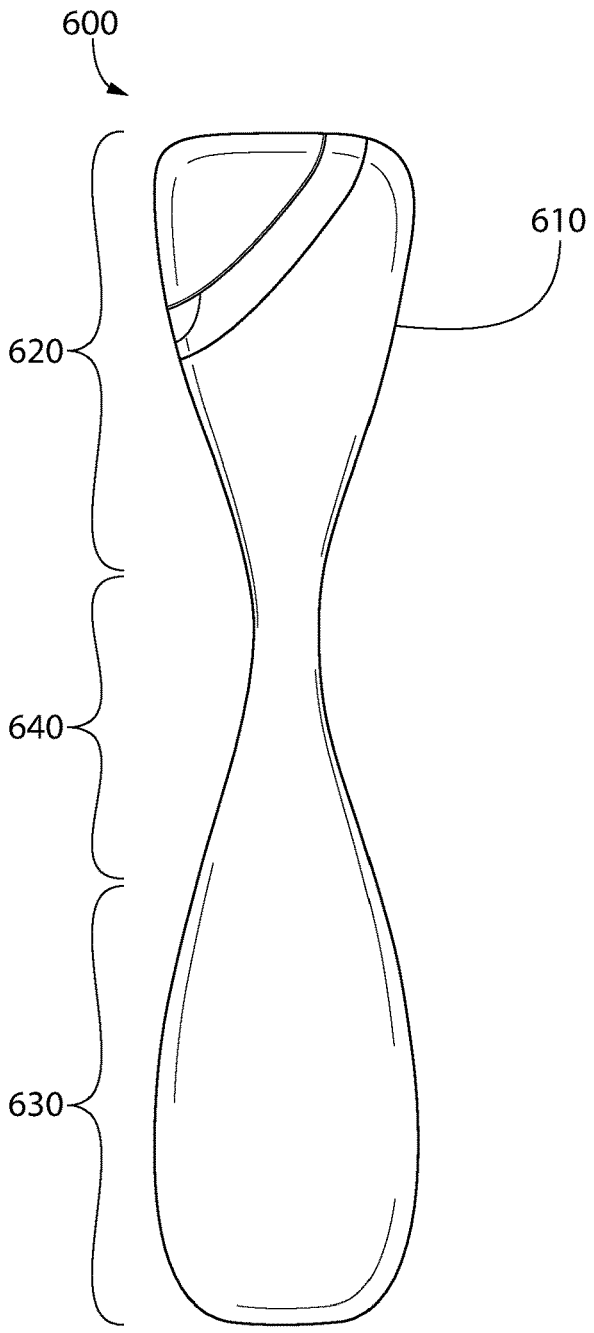
FIG. 6 depicts a front view of another hourglass-shaped, according to an embodiment.
Figure 7:
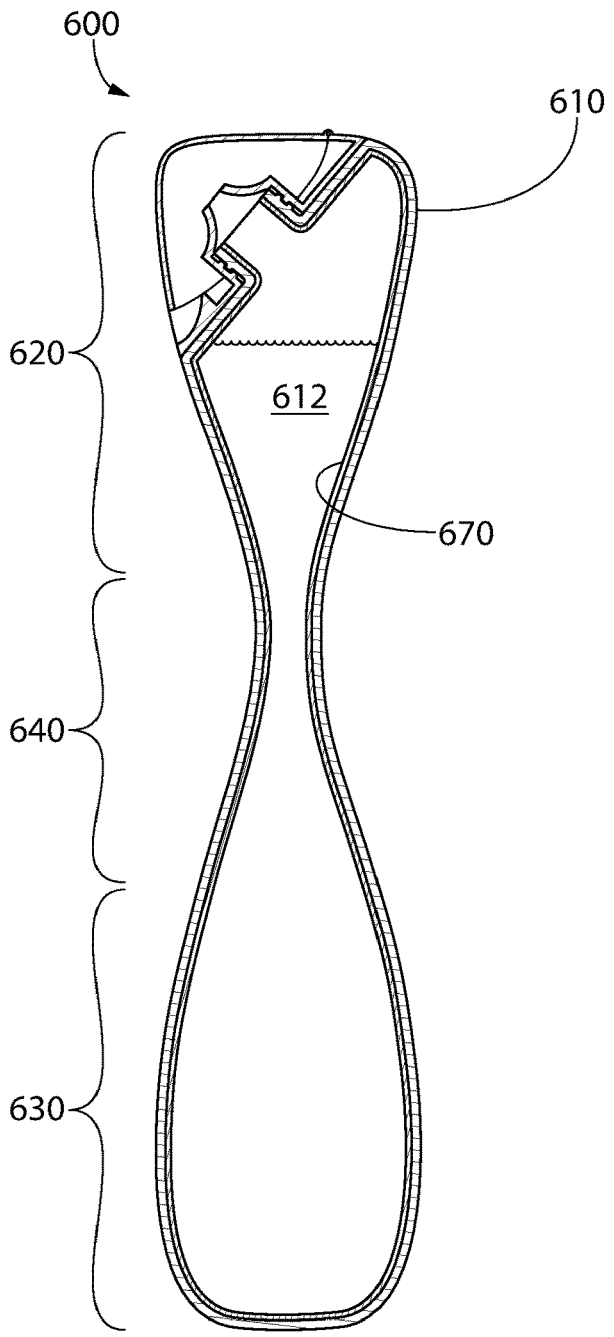
FIG. 7 depicts a cross-sectional view of the hourglass-shaped dispenser of FIG. 6, according to an embodiment.

FIGS. 6 and 7 depict a front view and a cross-sectional view, respectively, of another hourglass-shaped dispenser 600, according to an embodiment. In contrast to the upper and lower portions 420, 430 of the dispenser 400 shown in FIGS. 4 and 5 that are at least partially substantially spherical or spheroid-shaped, the upper and lower portions 620, 630 of the dispenser 600 shown in FIGS. 6 and 7 are at least partially substantially frustoconical. In addition, the upper and lower portions 620, 630 of the dispenser 600 are slimmer than the upper and lower portions 420, 430 of the dispenser 400.

The dispenser 600 may include the composition 612 therein and have the coating 670 on the interior of the body 610 that allows, facilitates, or reduces the resistance of the composition 612 to moving around within the body 610 with minimal friction.

Figure 8:
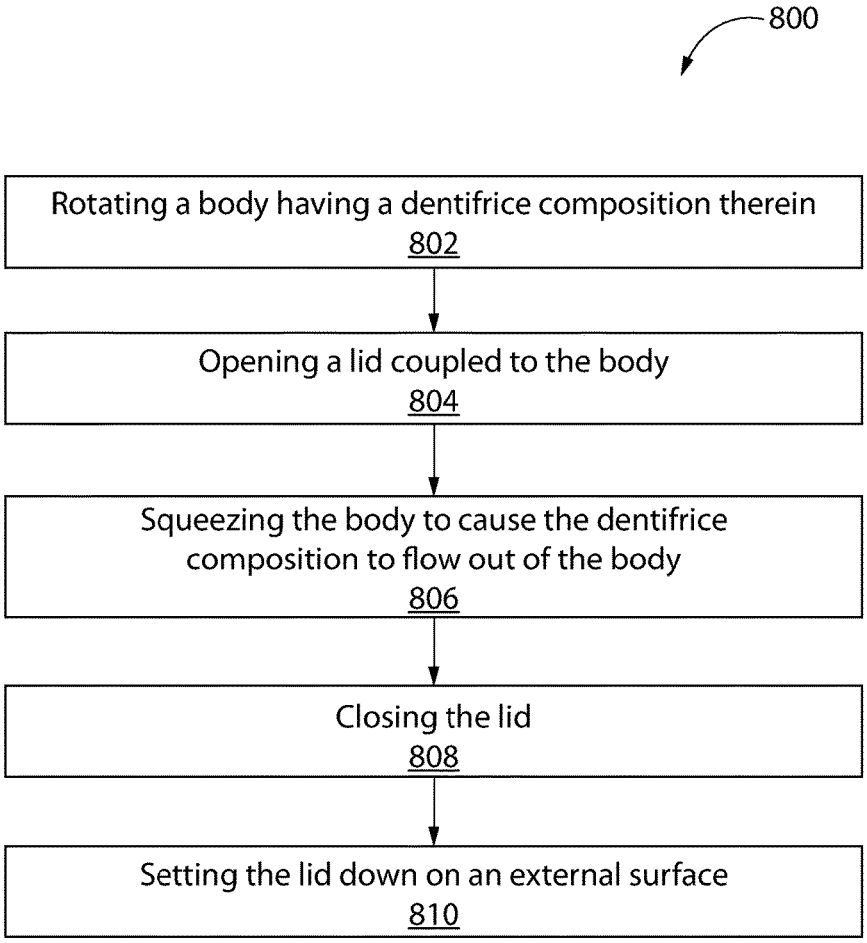
FIG. 8 depicts a flowchart of a method for manufacturing a dispenser, according to an embodiment.

FIG. 8 depicts a flowchart of a method 800 for dispensing a composition from a dispenser 100, 400, 600, according to an embodiment. The method 800 may include rotating a body 110, 410, 610, as at 802. The body 110 may be rotated from about 45° to about 90°, about 90° to about 180°, or more. In one embodiment, this may include rotating a spiral-shaped body 110 about a longitudinal axis that is perpendicular to a plane that includes a curved central axis 118 through the body 110. In another embodiment, this may include rotating an hourglass-shaped dispenser 400, 600 such that an upper portion 420, 620 and a lower portion 430, 630 swap positions relative to the ground.

The method 800 may also include opening a lid 130, 460, 660 that is coupled to the body 110, 410, 610 to cause/allow the composition 112, 412, 612 to flow out of the body 110, 410, 610, under the influence of gravity as at 804. The lid 130, 460, 660 may be opened before or after the body 110, 410, 610 is rotated. The method 800 may also include squeezing the body 110, 410, 610 to cause/allow the composition 112, 412, 612 to flow out of the body 110, 410, 610, under the influence of increased internal pressure caused by the squeezing as at 806. The method 800 may also include closing the lid 130, 460, 660, as at 808, and setting the lid 130, 460, 660 down on an external, substantially horizontal surface (e.g., a counter top) such that the lid 130, 460, 660 is positioned between the external surface and the body 110, 410, 610, as at 810. In some embodiments, the body, instead of the lid 130, 460, 660, may be set down on an external surface.

What is claimed is:

1. A dispenser, comprising:

a body consisting essentially of:

a first portion defining a first internal volume;

a second portion defining a second internal volume;

a neck portion positioned between the first and second portions and providing a path of fluid communication between the first and second internal volumes;

an opening providing a fluid flow path between the first and second internal volumes and an exterior of the body, wherein the opening is offset from a central longitudinal axis of the body; and a lid coupled to the body and selectively covering the opening; and a composition in the first internal volume, the second internal volume, or both.

2. The dispenser of claim 1, wherein the body is transparent such that the composition is visible from an exterior of the body.

3. The dispenser of claim 2, further comprising a coating on an inner surface of the body, wherein a coefficient of friction between the composition and the coating is less than a coefficient of friction between the composition and the inner surface of the body.

4. The dispenser of claim 1, wherein a cross-sectional width of the first portion decreases proceeding from the maximum cross-sectional width of the first portion toward the minimum cross-sectional width of the neck portion.

5. The dispenser of claim 1, wherein an axial end of the first portion comprises a flat outer surface, and wherein an axial end of the second portion comprises a flat outer surface.

6. The dispenser of claim 1, wherein the opening is formed through the neck.

7. The dispenser of claim 1, wherein the composition is one of a toothpaste, tooth powder, tooth soap, mouthwash, lotion, soap, shampoo, conditioner, dish detergent, laundry detergent, fabric softener and surface cleaner.

* * * * *